US008887640B1

(12) United States Patent
Knight et al.

(10) Patent No.: US 8,887,640 B1
(45) Date of Patent: Nov. 18, 2014

(54) ELECTRO-MECHANICAL FUZE FOR HAND GRENADES

(75) Inventors: Ryan R. Knight, Chevy Chase, MD (US); Oliver M. Barham, Washington, DC (US); Thinh Q. Hoang, Beltsville, MD (US); Robert H. Wood, Laurel, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 41 days.

(21) Appl. No.: 13/608,494

(22) Filed: Sep. 10, 2012

(51) Int. Cl.

| | |
|---|---|
| ***F42B 27/00*** | (2006.01) |
| ***F42C 11/02*** | (2006.01) |
| ***F42C 11/06*** | (2006.01) |
| ***F42C 15/20*** | (2006.01) |
| ***F42C 15/40*** | (2006.01) |
| ***F42C 14/02*** | (2006.01) |
| ***F42C 11/00*** | (2006.01) |
| *F24C 15/20* | (2006.01) |

(52) U.S. Cl.

CPC ..... *F42C 11/008* (2013.01); *F42C 14/025* (2013.01); *F24C 11/02* (2013.01); *F24C 15/40* (2013.01); *F24C 11/06* (2013.01); *F24C 11/003* (2013.01); *F24B 27/00* (2013.01); *F24C 15/20* (2013.01)

USPC ..... 102/487; 102/210; 102/261; 102/264; 102/266

(58) Field of Classification Search

CPC ..... F42C 11/02; F42C 11/003; F42C 11/06; F42C 11/008; F42C 14/02; F42C 14/025; F42C 15/20; F42C 15/21; F42C 15/34; F42C 15/40; F42B 27/00

USPC ..... 102/202.5, 206, 207, 209, 210, 215, 102/216, 218, 222, 258, 260, 261, 262, 264, 102/266, 269, 482, 487, 488

See application file for complete search history.

(56) References Cited

U.S. PATENT DOCUMENTS

| | | | | |
|---|---|---|---|---|
| 3,505,959 | A * | 4/1970 | Bedall et al. | 102/256 |
| 3,941,058 | A * | 3/1976 | Gawlick et al. | 102/210 |
| 3,963,966 | A * | 6/1976 | Mohr | 361/260 |
| 3,967,555 | A * | 7/1976 | Gawlick et al. | 102/210 |
| H251 | H * | 4/1987 | Field | 102/487 |
| 5,196,649 | A | 3/1993 | DiRubbio et al. | |
| 5,269,223 | A * | 12/1993 | Mattsson et al. | 102/210 |
| 5,445,077 | A | 8/1995 | Dupuy et al. | |
| 6,082,267 | A | 7/2000 | Cooper | |
| 6,321,654 | B1 | 11/2001 | Robinson | |
| 7,013,809 | B1 | 3/2006 | Munoz Bueno | |
| 7,197,983 | B2 | 4/2007 | Barth et al. | |
| 7,712,419 | B1 | 5/2010 | Cheng et al. | |
| 8,640,620 | B1 * | 2/2014 | Hoang et al. | 102/256 |

* cited by examiner

*Primary Examiner* — James Bergin
(74) *Attorney, Agent, or Firm* — Michael C. Sachs

(57) ABSTRACT

A safety fuze includes a magneto striker generator (MSG) as its a power generation source. The MSG provides energy to energize an electronic unit and a safety and arming device. The safety fuze allows safety and arming of military hand grenades, with a fully out-of-line explosive initiator and an integrated power generation means, for improving safety and performance. The MSG includes a striker and a receiving bobbin that houses a conductive coil. The striker comprises a permanent magnet that is mounted on a pivot mechanism for allowing a rotational displacement of the permanent magnet, into the bobbin, in order to generate an electrical current. As the permanent magnet is being inserted inside the bobbin, the magnetic flux change induces an electric current in the coil, creating the necessary energy for the fuze operation.

10 Claims, 10 Drawing Sheets

ELECTRO-MECHANICAL FUZE FOR HAND GRENADES

GOVERNMENTAL INTEREST

The invention described herein may be manufactured and used by, or for the Government of the United States for governmental purposes without the payment of any royalties thereon.

FIELD OF THE INVENTION

The present invention relates in general to the field of munitions. More specifically, this invention relates to electro-mechanical safety fuzes for hand emplaced grenades for military and commercial uses. In particular, the present electro-mechanical safety fuze allows safety and arming of military hand grenades, with a fully out-of-line explosive initiator and an integrated power generation means, for improving safety and performance.

BACKGROUND OF THE INVENTION

Safety is a very important design aspect of a hand grenade fuze. Fuze designs account for a time delay period from initiation, for the detonation to occur, in order to ensure that the grenade is cast outside the explosion hazard area. As a result, it is essential that this time delay does not run short, and be precisely controlled.

Some of the current hand grenades employ a simple chemical powder delay column to effect a timing delay before function, which is permanently in-line with a primer explosive element and a detonator/high explosive fill, creating a potential safety hazard and the ability for unintended initiation of the device. For example, overheating due to inflammation, or primer functions at low temperatures. In addition, this method of fuzing does not offer a very accurate, repeatable delay time across many units, due to hygroscopic effects on the powder and poorly controlled delay column densities.

Conventional mechanical time delay fuzes are either operated by a spring or a pyrotechnic delay element. However, these mechanical delay fuzes present numerous inherent problems, including but not limited to: the inability to be stored for an extended period of time, inconsistent timing to detonation, dependency on temperature, susceptibility to aging, subject to manufacturing inaccuracy.

Conventional electric time delay mechanisms have been designed to overcome the problems associated with the mechanical time delay mechanisms. These electric time delay mechanisms generally included an electric energy source and an electronic delay circuit. Even though these electric time delay circuits have proven to be more reliable than their mechanical counterparts, they in turn, present inherent disadvantages. As an example, the electric time delay mechanisms are predisposed to unintended electrical activation, that can lead to the premature and unintentional detonation of the hand grenade.

What is therefore needed is a fuze design that overcomes the aforementioned problems associated with the conventional in-line (primer to detonator) mechanical and electrical time delay mechanisms, and yet still fits within the existing hand grenades designs, with minimal manufacturing variances, in order to maintain the same user directions and training as for existing hand grenades. Prior to the advent of the present invention, the need for such a fuze design has heretofore remained unsatisfied. The minimal manufacturing variances are important in order to allow the use of conventional manufacturing, such as molding, machining, etc., and further to minimize changes to the assembly lines.

SUMMARY OF THE INVENTION

The present invention satisfies this need, and describes an electro-mechanical fuze, primarily for use in military hand grenade applications (but not limited thereto, with potential applications in civilian commercial and aerospace systems). The present fuze incorporates interrelated mechanical and electronic safety logic for reliability and safety, introduces an initially out-of-line firetrain, and electronic timing, such that safety and reliability will be increased as compared to the existing state of the art hand grenade fuze.

The inventive fuze incorporates several important concepts, among which are the following. The fuze includes an electronic fuze architecture that allows for selectable accurate time delay or impact function. Power can be provided to the fuze in a variety of different ways, such as a magneto-striker generator (MSG). Power could also be provided to the fuze by means of a piezoelectric striker generator (PSG).

Additionally, a safety and arming device is incorporated in the present design. Preferably, the safety and arming device is of the type described in the co-pending U.S. application Ser. No. 13/411,918, titled "MEMS-Based Electromechanical Safety and Arming Device for Non-Inertial and Non-Spin Applications," which was filed on Mar. 5, 2012, and which is incorporated herein by reference in its entirety. The safety and arming device includes a moveable component in a micro-scale firetrain which isolates all primer sensitive explosives from being in-line with the secondary insensitive detonating explosives. When armed, the safety and arming device is initiated, builds from a deflagrating spot charge to a detonating output at the output end of the safety and arming device assembly, and allows for increased safety of the hand grenade during storage, transport and scenarios not intended to cause function.

When the present fuze is used in military applications, it must satisfy the requirements placed on fielded hand grenades by the US Military. To this end, the fuze may utilize existing safety components, such as the safety pin and safety lever, while introducing a novel safety and arming device that was not previously used in military hand grenades. The additional features found in the fuze device allow for a wide range of potential applications (e.g., allowing grenades to function on impact, function on an impact time delay, function after a time delay, function on enemy pickup, etc.), while increasing safety.

The present design enables the use of several sensors that can be used to control the operation of the fuze. The present fuze can include a capacitive sensor that is commonly used found, for example, in cell phones, to detect the proximity of the user's face to the cell phone. The capacitive sensor could be integrated within the fuze to function when the enemy tries to pick up the hand grenade and throw it back.

In addition to the added safety, the integration of the present fuze design in an existing hand striker body is transparent to the end user, in terms of appearance, means of operation, performance, and handling characteristics. This transparent integration is important in that if numerous external changes were made to the grenade, entirely new training regimen would be necessary to effectively communicate the operation of fuze to the military personnel and, thus, greatly increasing cost to deploy the system.

To this end, the present fuze generally includes a power generation source, such as a magneto striker generator, an electronic unit, and a non-inertial safety and arming (S&A)

device. The MSG provides energy to energize the electronics unit and the safety and arming device.

The MSG generally includes a striker and a receiving bobbin that houses a conductive coil. The striker comprises a permanent magnet (or magnetic block) that is mounted on a pivot mechanism (such as, for example, the spring-activated striker mechanism on many currently fielded military hand grenades) for allowing a rotational displacement of the permanent magnet, into the bobbin, in order to generate an electrical current.

When the fuze is in a safe, deactivated state, the fuze is deactivated and the grenade is safe to handle, in that the fuze does not generate any power, and the S&A keeps the firetrain out of line until arming. Upon MSG function and subsequent fuze energizing, the fuze circuit will command the MEMS S&A to remove its safety locks and subsequently under an applied magnetic field, become in-line and ready to detonate.

Once the MSG is set in motion (assuming a spring-loaded pivot mechanism is employed), the striker is released from its normally secure position, and the fuze enters an unarmed but activated state. The fuze remains unarmed until a predetermined period, e.g. approximately 20 milliseconds, before detonation. The striker pivots around a pivot point, propelling the permanent magnet therealong, until the permanent magnet is inserted into the receiving bobbin. The relative motion of the permanent magnet to the conductive bobbin coils induces an electric current to flow within the coils; thereby energizing the electronic unit. In turn, the electronic unit uses an intrinsic logic circuit to initiate the explosive train when desired.

According to another embodiment of the present invention the fuze includes an alternative means for generating electrical power. Such alternative energy generation method include a piezoelectric striker generator (PSG) that replaces the MSG. The PSG could also utilize the motion of a pivoting element, but instead of inserting a permanent magnet into a conductive coil, a block with a predetermined mass would effect momentary impact with a piezoelectric element connected to the electronic unit, to generate energy through impact and compression of the crystal.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
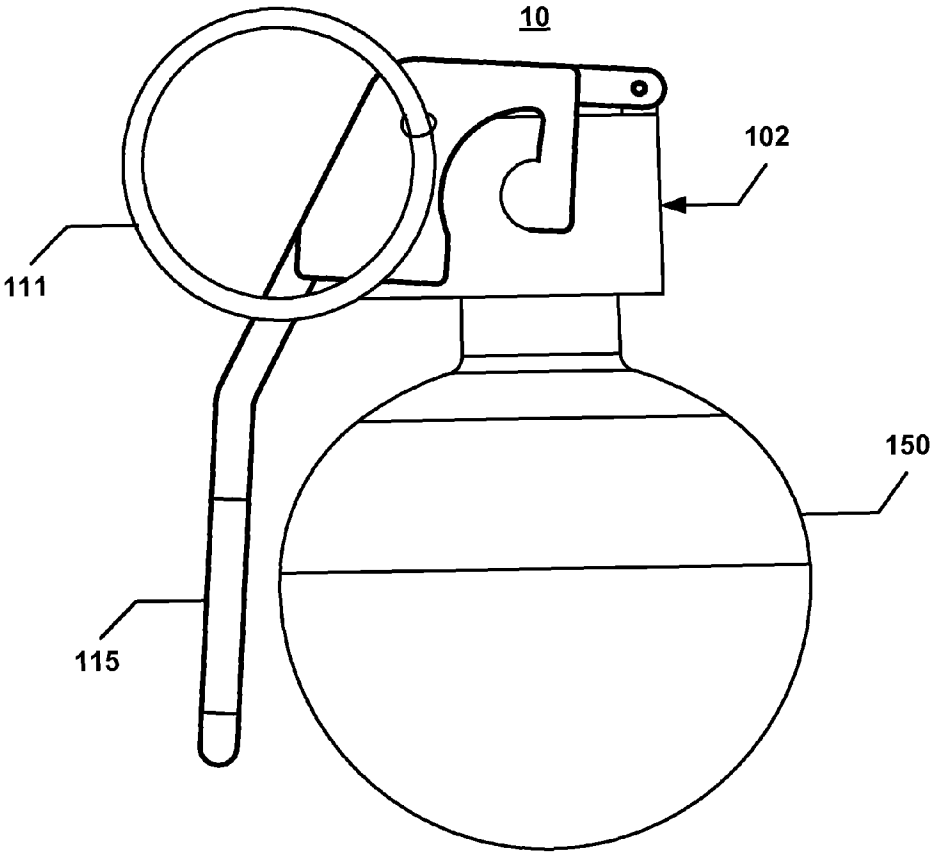
FIG. 1 is a side view of a notional hand grenade utilizing an electro-mechanical fuze according to the present invention, which incorporates a safety ring and a safety lever.

FIG. 1 illustrates a hand grenade 10 that incorporates an electro-mechanical fuze 100 (FIGS. 2, 3) of the present invention. In addition to the added safety measures, the fuze 100 can be readily integrated in a conventional or available striker body 102 in a way that is transparent to the end user, in terms of appearance, means of operation, performance, and handling characteristics. This transparent integration is important in that it does not necessitate changes to the training regimen on the use of the hand grenade 10.

Figure 2:
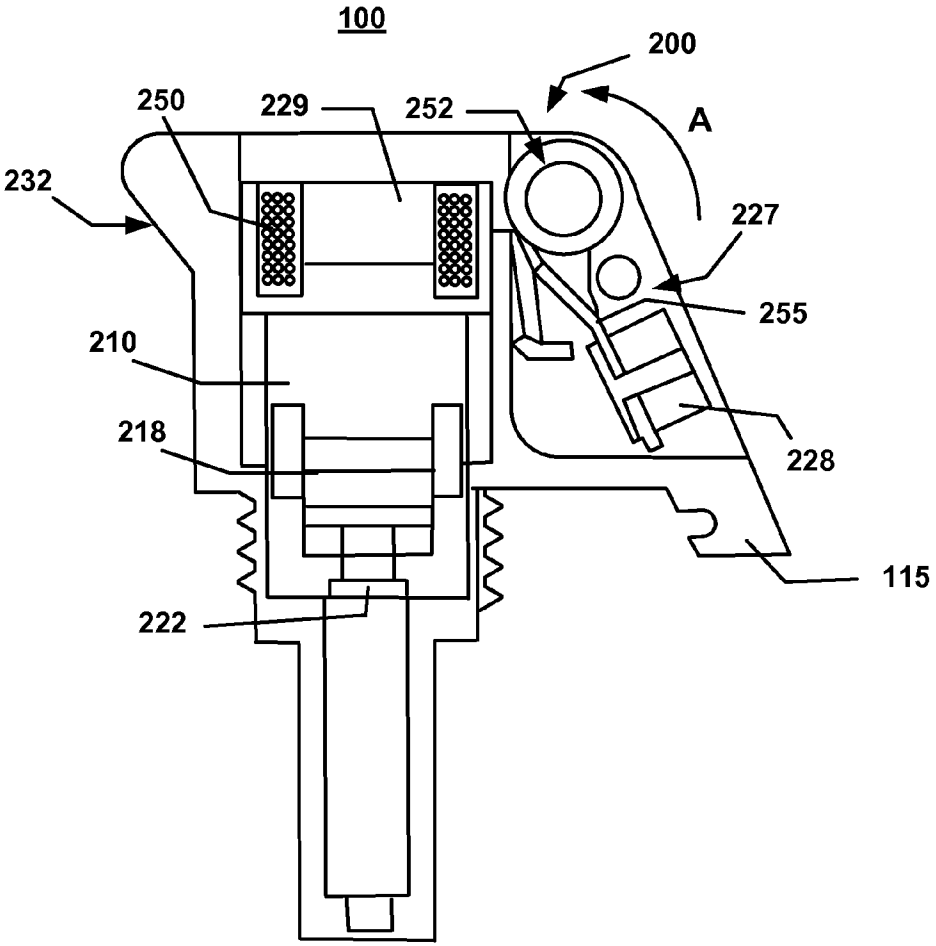
FIG. 2 is a sectional view of the electro-mechanical fuze of FIG. 1, with the safety ring, the safety lever, and the cross-hatching removed for clarity of illustration, showing the electro-mechanical fuze in a safe, deactivated state, and further illustrating the use of a magneto striker generator (MSG) as the energy source for the fuze.
Figure 3:
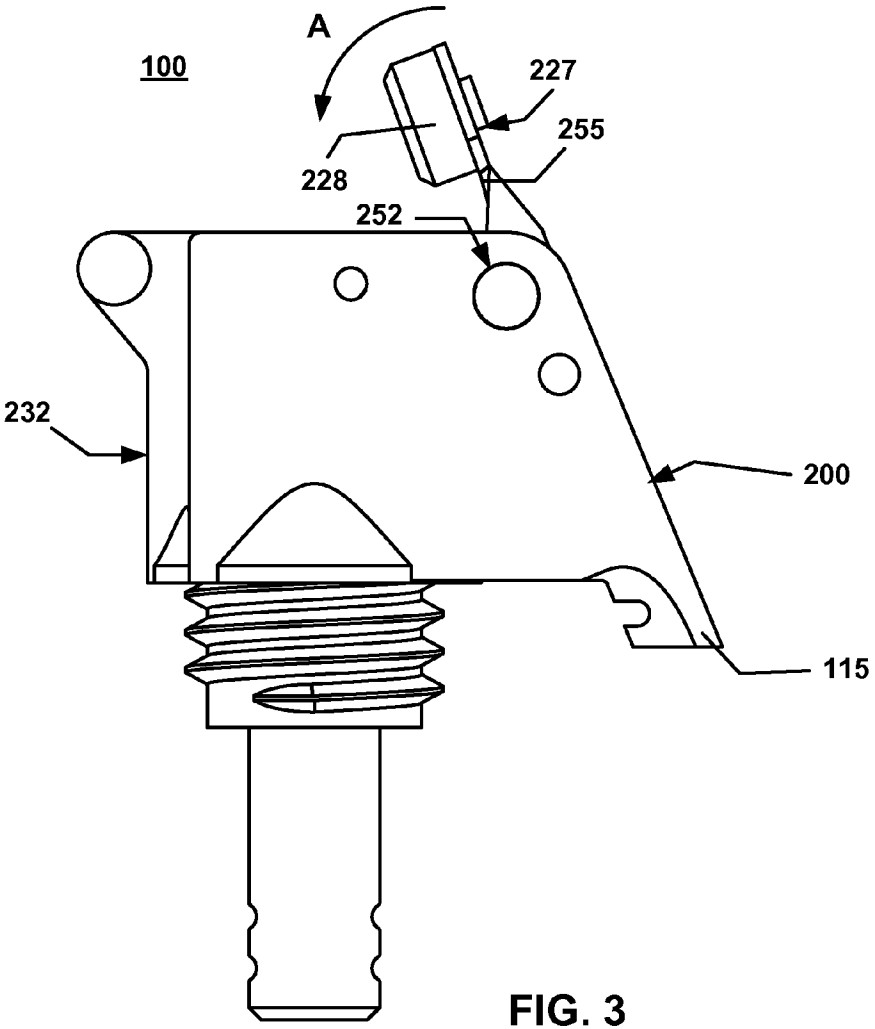
FIG. 3 is a side view of the electro-mechanical fuze of FIGS. 1 and 2, in an intermediate position, between the deactived state of FIG. 2 and an activated state of FIG. 7.
Figure 4:
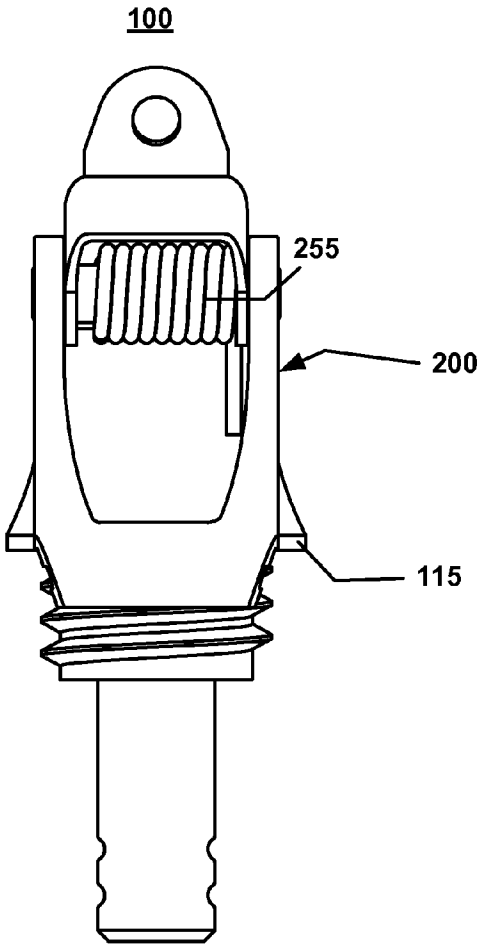
FIG. 4 is a front view of the electro-mechanical fuze of FIG. 3.
Figure 5:
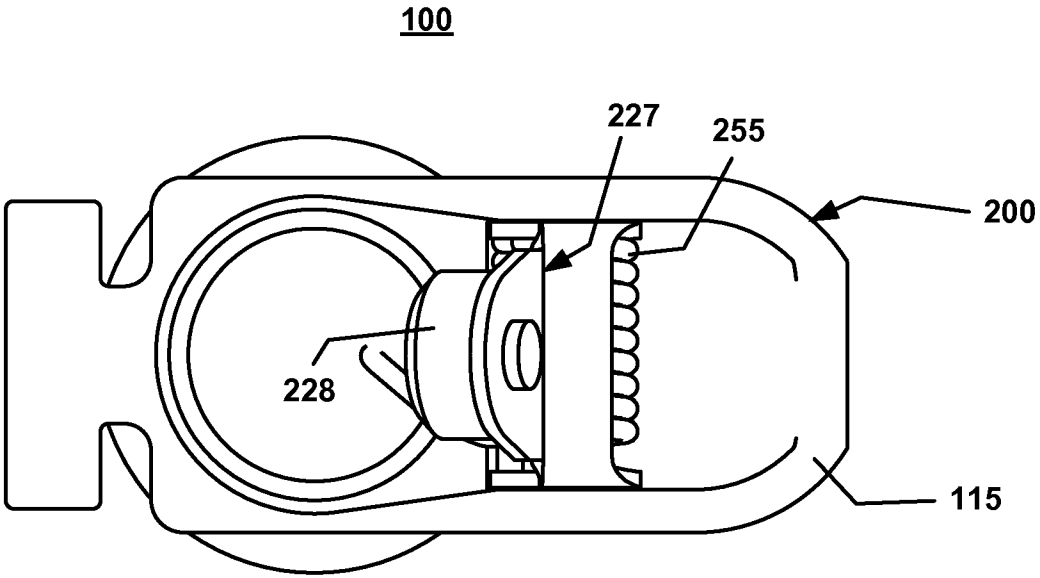
FIG. 5 is a top view of the electro-mechanical fuze of FIGS. 3 and 4.
Figure 6:
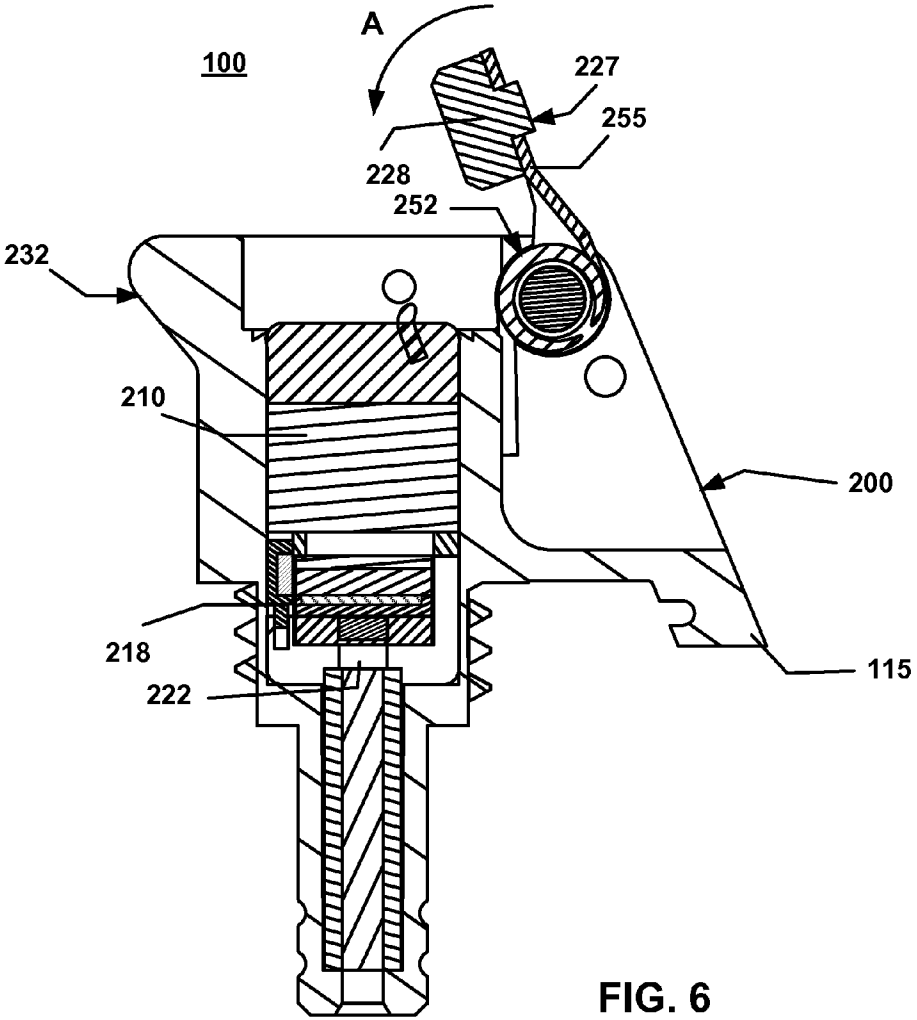
FIG. 6 is a sectional view of the electro-mechanical fuze of FIGS. 2-5.

In this example and with further reference to FIG. 2, the hand grenade 10 generally includes a fuze 100 which is secured to a grenade body 150, as well as manual safety devices, such as a safety pin 111 and a safety lever 115 that are secured to a fuze body 102. The hand grenade 10 contains and houses the fuze 100, so that its presence is transparent to the user.

In a preferred embodiment, FIG. 2, the fuze 100 includes a power generation source, such as a magneto striker generator 200, an electronic unit 210, and a non-inertial safety and arming device 218.

The MSG 200, provides energy to energize the electronics unit 210 and the safety and arming device 218. The MSG 200 generally includes a striker 227 and a receiving bobbin 229 that houses a conductive coil 250. The striker 227 comprises a permanent magnet (or magnetic block) 228 that is mounted on a pivot mechanism 252 for allowing a rotational displacement of the permanent magnet 228, into the bobbin 229, in order to generate an electrical current (or power). To this end, the exemplary embodiment illustrates the pivot mechanism 252 as including a spring (or elastic element) 255 that attaches at one end to the permanent magnet 228, and that is secured at its other end to a striker pivot point 261.

When the fuze 100 is in a safe, deactivated state (FIG. 2), the spring 255 is in a helical torsion configuration (though it is not limited to such configuration), and is disposed within, and preferably completely housed inside the safety lever 115, while the bobbin 229 is remotely located within the fuze body 102. In this state, the fuze 100 is deactivated and the grenade 10 is safe to handle, since the fuze 100 does not generate any power, and the striker 227 keeps the firetrain out of line until arming.

Figure 7:
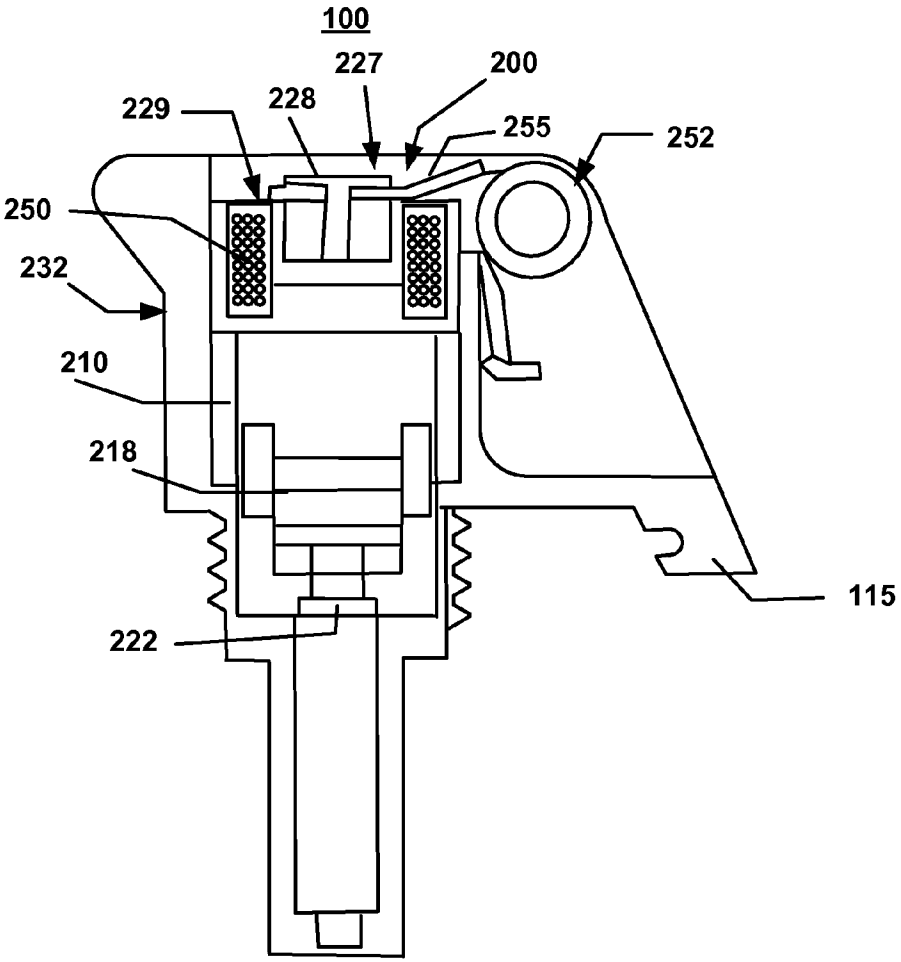
FIG. 7 is another sectional view of the hand grenade of FIGS. 1 and 2, illustrating the electro-mechanical fuze in an armed, activated state.

Once the MSG 200 is set in motion by the release of the striker 227 from its normally secure position, the fuze 100 enters an activated state and will arm after a time delay (FIG. 7). As illustrated in FIGS. 3 through 6, the spring 255 rotates around the striker pivot point 261, in the direction of the arrow A, propelling the permanent magnet 228 to rotate therealong, through its range of motion of approximately 250 degrees of rotation, until the permanent magnet 228 is rapidly inserted into the bobbin 229. The rotary motion of the permanent magnet 228 inside the bobbin 229 induces an electric current to flow within the conductive coil (or winding) 250; thereby energizing the electronic unit 210. In turn, the electronic unit 210 uses an intrinsic logic circuit to initiate the explosive train when desired.

The safety and arming device 218 is preferably fabricated using micro-machining or MEMS technology (e.g. lithography, plating and molding) to obtain the desired precision and micron-scale tolerances, thus allowing for the safety and arming of the hand grenade 10. As explained, for example, in the co-pending U.S. application Ser. No. 13/411,918, the safety and arming device 218 effects the arming of the fuze 100 through the movement of an internal mechanism, the motion of which aligns a micro-scale firetrain which, when initiated, will propagate through an output charge 222 (FIG. 2), causing the main explosive charge encased within the grenade 10 to function.

In addition to the aforementioned components, the fuze 100 also includes a mechanical assembly to align all of the components in the desired orientation required for the operation of the hand grenade 10. This alignment is magnetically driven by closely positioning of the magnet 200 next to the safe and arming device 210.

The use of the electro-mechanical fuze 100 allows safety and arming of the hand grenade 10, utilizing miniaturized and advanced electronic circuitry and logic in various military and commercial applications. Additionally, the micro-scale manufacturing techniques utilized in the non-inertial (or equivalent) safety and arming device 218, permit munition fuze designers to place the fuze 100 inside the existing small volume of a standard military hand grenade safety lever 115.

The incorporation of advanced electronics and logic circuits in the fuze 100, where such placement was previously not possible due to size and power limitations, permits accurate timing, more accurate impact sensing, and subsequently greater safety than, for example, pyrotechnic powder delay column fuzes.

Moreover, safety is a paramount design goal of the fuze 100. A conventional hand grenade typically has a normally in-line explosive train that is composed of sensitive primary and insensitive secondary explosives. The present fuze 100 allows for the replacement of the in-line explosive train, through the safety and arming device 218, with a normally out-of-line system, thus increasing safety.

The safety of the safety and arming device 218 of the fuze 100 is derived from the selective mechanical and electro-mechanical logic that is intrinsic to the design of the fuze 100. Predetermined external inputs are used as triggers for the devices arming actions, and inputs that do not match those required, in the proper sequence, result in one of two outcomes:

a) The mechanical logic elements may partially respond to the inputs and then reset to their original "safe" (unarmed) position by a bias unarming spring or elastic element (the fuze can still be armed later if the proper input is seen later), or b) The mechanical logic elements may partially respond to the inputs and due to the out-of-sequence or improper nature of the inputs the mechanical elements may finish in a "failed safe" condition. The fuze will not operate unless the correct sequence of mechanical logic elements function is found.

The electronic unit 210 includes components, such as a timer, logic circuitry, a processor, and sensors that are either known or available in the field of the application, to provide the logic necessary for processes such as the operation of advanced sensors, timing, logic operations and initiation of the firetrain intrinsic to the operation of the fuze 100.

From the manufacturing stage to the point of use, the hand grenade fuze 100 will experience diverse dynamic and inertial inputs. The inertial inputs include, for example, impacts, accelerations, and a spectrum of vibration inputs resulting from the manufacturing-imposed loads in the factory, manual handling, inspection, packaging, freight loading, transportation, storage, and logistical deployment. The fuze 100 is designed to reject all such inputs and combinations thereof, up to but not including the inputs desired for operation. The fuze 100 will also reject logistical acceleration inputs such as impacts, so far as arming is concerned, again because of the mechanical logic intrinsic to the safety and arming device 218.

The fuze 100 may initiate its lead charge under high-temperature cookoff, but it will fail safe (i.e., will not detonate) due to its MEMS S&A out-of-line nature. In addition, if the fuze 100 is hit with a bullet or another object that penetrates the fuze body, the fuze 100 will fail safe.

As an example, during the course of intended operation, the fuze 100 may encounter environmental conditions or designated inputs that the designer wishes to use as triggers for fuze arming. For illustration, a hand-grenade 10 equipped with the fuze 100 may require a soldier to pull the safety pin 111 (FIG. 1) and to release the safety lever or handle 115, in order to trigger an arming sequence, followed by acceleration due to throwing of the grenade 10, and potential impact with a target or non-target object. Whatever the actions leading to the fuze receiving the desired inputs, the outcome will always be the same: the mechanical arming of the fuze 100.

The striker 227 is not affected by the dynamic and inertial inputs because it is prevented from displacement from its resting or safe position, by means of the safety lever 115. The electronic unit 210, being devoid of moving parts, is not generally affected by these inputs.

A process 400 for the use and operation of the grenade 10 and more specifically the fuze 100 will now be described in connection with FIG. 8. The safety of the fuze 100 is enhanced by the requirement that the arming of the fuze 100 necessitates that the arming inputs occur in a specific sequence or order. The fuze electronic logic, which is contained in the electronic unit 210, combined with the safety and arming device 218, allows only the correct inputs, in the correct order to effect the arming of the fuze 100 and to allow it to function.

FIG. 2 illustrates the striker 227 in its initial resting position, and the spring 225 in a tensioned state. Upon release of the initial safety locks (e.g., the safety pin 111 and the lever 115, shown in FIG. 1), the striker 227 becomes free to rotate around its pivot point 252 (FIG. 2), and to reach its final resting state, with its permanent magnet 228 inserted inside the bobbin 229. As the permanent magnet 228 is being inserted inside the bobbin 229, the magnetic flux change induces an electric current in the coil 250 (conductive windings of the bobbin 229), creating the necessary energy for the fuze operation.

The process (or logic) 400 of operation of the fuze 100 is preferably, but not necessarily, programmed into the electronics circuit 210, to control the interaction of the fuze 100 with the other fuze components and its environment.

The present notional grenade 10 includes two safety locks: the safety pin (or ring 111) and the safety lever 115. Both of these safety locks may be retained from the existing art to help increase the operator familiarity with the system operation and safety. If, as shown in blocks 405 and 410, either of these safety locks were to be removed unintentionally, leaving the other in place, the device would remain safe for the user. Additionally, if the primary explosive in the grenade 10 were unintentionally set off, while the fuze 100 is still in a safe state, the explosion would not propagate through the explosive train, leaving the grenade 10 safe to the operator. As a result, the present fuze 100 presents a significant advantage in its ability to keep the operator (or user) safe from unintended grenade function.

Figure 8:
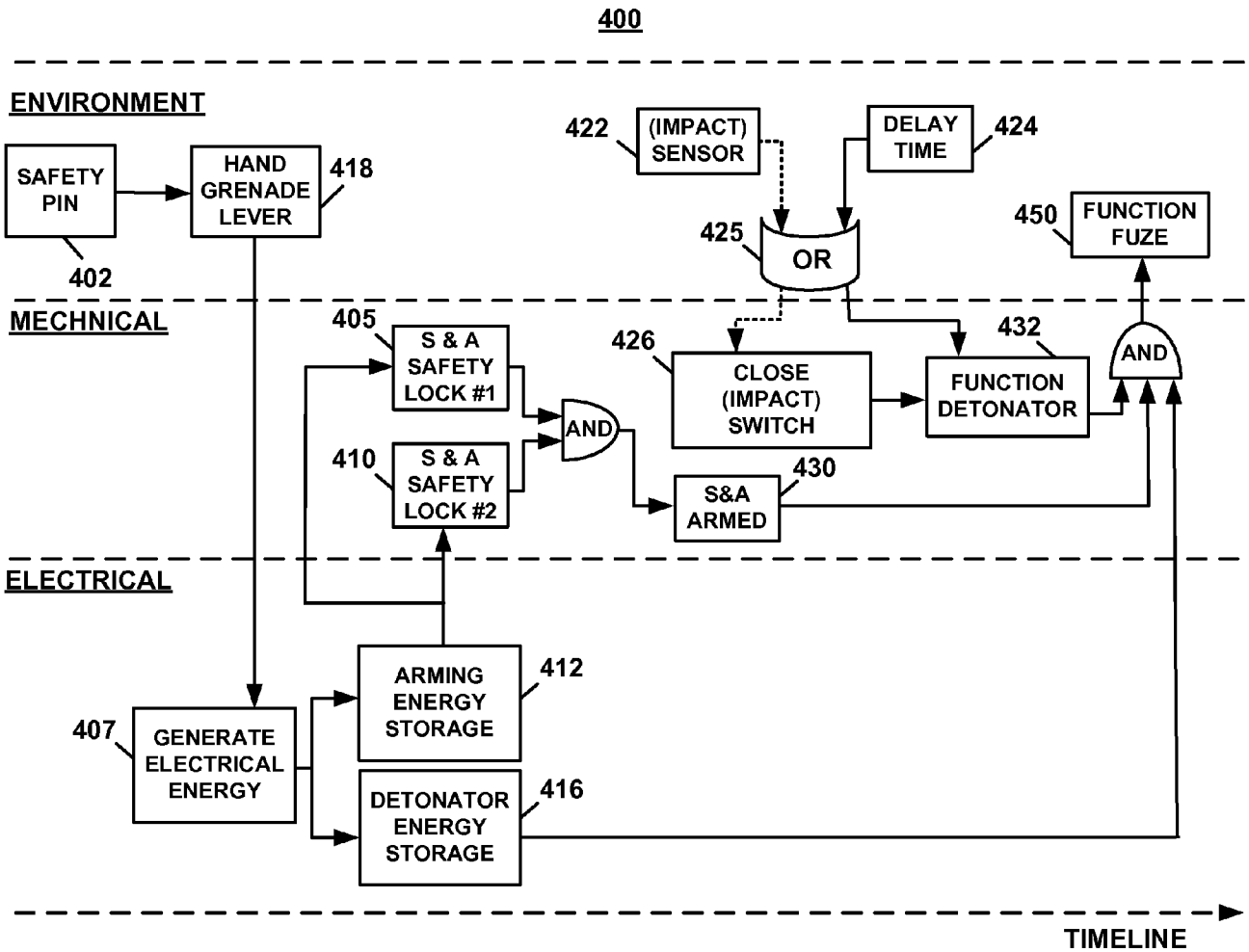
FIG. 8 is a block-diagram description of the operation and use of the hand grenade of FIGS. 1-7.

With reference to FIG. 8, the sequential removal of the safety pin (or ring) 111 at block 402, and the release of the hand grenade lever 115 at block 418, cause the striker 227 to pivot in position within the bobbin 229, in order to generate electrical energy (block 407), as explained earlier.

The generation of the electrical energy at block 407 causes, as an example, two energy storage capacitors to divide up the energy generated on separate circuits: a circuit dedicated to timing and/or impact sensing and a circuit isolated from the timing circuit that detonates the hand grenade. The arming energy storage 412 is generally comprised of a diode rectification scheme and a storage capacitor, and the detonator energy storage 416 is similar to the arming energy storage 412.

The arming energy storage 412 stores potential energy generated at block 407 and awaits the removal of the second S&A safety lock (block 410). The removal of the second S&A safety lock (block 410), in combination with the arming energy storage (block 412), enable the safety and arming device 218, at block 430.

The first S&A safety lock (block 405) and the second S&A safety lock (block 410) are preferably similar in design and function. The removal of the first safety lock (block 405) allows a slight travel of the MEMS S&A and to engage the second safety lock (block 410). Both S&A safety locks (blocks 405, 410) are both removed by a pyrotechnic charge that creates positive pressure gas in the locks' cavities, causing the locks to rotate and plastically deform into the unlocked position. The removal of the two locks (blocks 405, 410) allows for the striker 227, effectuated by a magnetic field, to translate into the "armed" state.

The next step in the operation of the fuze 100 is illustrated by two alternative inputs to the fuze 100: either an optional impact of the grenade 10 with a target (block 422), or a time delay trigger (block 424), that are shown diagrammatically inputted to an OR gate 425. If the impact input occurs, as sensed by a sensor (block 422), then an impact switch, which forms part of the electronic unit 210, will close (block 426), setting off the detonator in the grenade 10 (block 432). If, on the other hand, the delay timer is detected (block 424), then the impact switch is bypassed and the detonator is set off at the end of the timer period (block 432).

Although the detonator function is activated (block 432), the detonator itself is not energized by the energy stored at the detonator energy storage (block 416). Once the following three conditions are satisfied: (1) the detonator function is active (block 432); (2) the S & A is armed (block 430); and (3) the energy stored at the detonator energy storage (block 416) is available, the fuze is activated (block 450) and the hand grenade detonates inline.

A preferred method of construction of the fuze 100 is to use as many known or available existing components as possible, for an intended application. This will result in decreased manufacturing costs, compared to the construction of an entirely new fuze, and increased familiarity to the end user.

To this end, it would be possible to use a striker body 232, FIG. 2, that has been modified to accept the bobbin 229 and the striker 227, with machining operations, such as boring a central column within the fuze body in order to create a cavity that accommodates the bobbin 229. The striker 227, including the permanent magnet 228 can be combined through methods such as, but not limited to glue/epoxy, screwing, staking, and/or machining as necessary. The permanent magnet 228 can either be a solid circular disc or it can have any other suitable geometry, such as square or rectangular. It can be hollow, with a pressed rivet holding it to the spring 255. The permanent magnet material can be a rare earth metal formulation with a high coercive field, such as NdFeB, but is not limited thereto.

The electronics circuit 210 can be manufactured from standard integrated circuit industry processes, and may or may not be comprised of flexible connector cables and circuit boards.

The safety and arming device 218 can be manufactured using a variety of manufacturing processes, including but not limited to, stamping, die casting, molding and sintering, etc. Some parts can take advantage of MEMS techniques such as wafer-based lithography, plating and molding technology (e.g. LIGA (Lithographie, Galvanoformung, Abformung)) to achieve parts with vertical side walls, smooth planar features/faces and tight in-plane dimensional tolerances on a micro scale (e.g., on the order of ±5 micrometers). The safety and arming device 218 used in a given application will determine the applicable fabrication and integration requirements.

The fuze 100 can be implemented at an arbitrary scale, for example at a scale that is larger than the typical feature sizes found in military hand grenades. Such a fuze 100 would have similar functions and features to those described herein, except that working clearances might be significantly larger or different.

It should be understood that the fuze 100 may include advanced sensors, such as impact switches, anti-tamper switches, acoustic sensors, capacitive sensors, and radio frequency or other electro-magnetic or remote-command signals.

Figure 9:
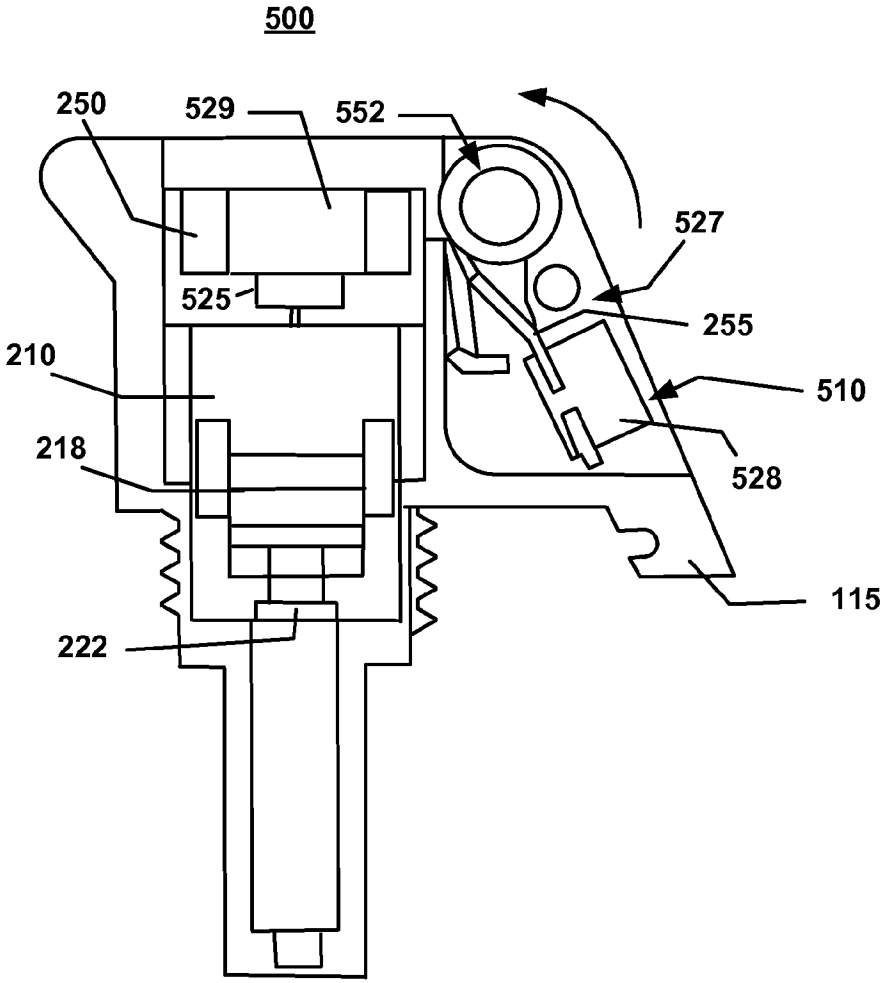
FIG. 9 is a section view of another hand grenade according to the present invention, illustrating the use of a piezoelectric striker generator (PSG) as the energy source for the fuze.

Another embodiment of the present invention is illustrated in FIG. 9, wherein a fuze 500 includes an alternative means for generating electrical power. Such alternative energy generation method may include, for example, an impact activated battery, or alternately, a piezoelectric striker generator 510, that replaces the MSG 200, with associated changes made to the fuze housing and electronics to incorporate the PSG 510. The PSG 510 could also utilize the motion of a striker 527, but instead of inserting a permanent magnet into a conductive coil, a block 528 with a predetermined mass would impact a piezoelectric element 525 connected to the electronic unit 210, creating energy through the mechanical stress generated in the piezoelectric crystal.

Figure 10:
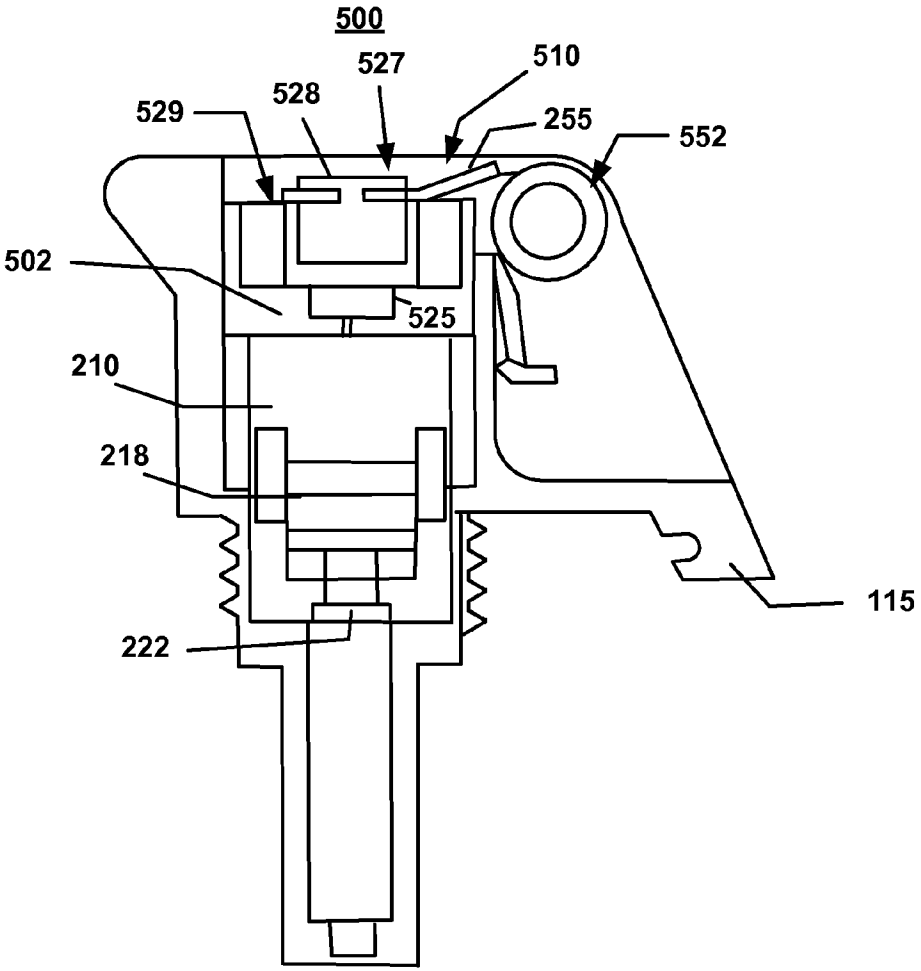
FIG. 10 is another section view of the hand grenade of FIG. 9, illustrating the electro-mechanical fuze in an armed, activated state.

As illustrated in FIG. 10, upon releasing the safety pin 111, the striker 527 rotates around the pivot point 552 so that the block 528 strikes the piezoelectric element 525, which is seated in a cavity 529 that is defined in a striker body 502, and rests within that cavity 529. The generated energy is stored and used, as explained earlier in connection with the process of FIG. 8.

According to yet another embodiment, the fuze utilizes a plurality of energy sources, including but not limited to a reserve battery, a magneto striker generator, and/or a piezoelectric striker generator.

While the invention has been described with reference to certain preferred embodiments, numerous changes, alterations and modifications to the described embodiments are possible without departing from the spirit and scope of the invention as defined herein, and equivalents thereof.

For example, an additional independent safety feature could also be introduced that would allow the fuze electronics to be switched ON or OFF. A switch could be added externally to the fuze 100, requiring user toggling. With the electronic unit 210 switched OFF, the release of the hand grenade safety lever 115 and the resulting rotary motion of the striker 227 would cause the fuze 100 to not function (dud). Conversely, with the electronic unit switched ON, the fuze 100 would function as intended. This second independent safety feature could allow for the fuze to be fully compliant with MIL-STD-1316 and STANAG 4187, military safety documents for "Department of Defense Design Criteria Standard: Fuze Design, Safety Criteria" and "Fuzing Systems—Safety Design Requirements," respectively.

In addition to the above, the implementation of self-destruct or self-neutralization functions and improved reliability would also be possible based on the electronic logic design and/or the addition of other sensors/devices.

In regard to military hardware, the present inventive can improve fuze performance and reliability; expand the field of applications for fuzes with electronic fuze circuits and sensors, therefore increasing the safety to end users. In addition to military hardware, potential commercial/civilian application exist, some of which are listed, along with possible military applications, below:

- A replacement for military fuzes (e.g. M204A2, M213, M228, etc.).
- Unmanned vehicle systems with integrated explosives.
- Submunition grenades and mines.
- Other military munition and explosive applications.
- Emergency circuit breakers for high-voltage (power industry) applications.
- Emergency escape hatches for reactors, tunnels, airframes, ships.
- Demolition and mining industry applications.
- Aerospace applications such as on-orbit locking mechanism de-activation.
- Other potential non-military applications such as within the commercial automotive industry (airbag safety; emergency lock-out prevention).

Certain aspects or features of the present invention, for example the magneto-striker generator 200 can also be applied to other devices and applications wherein such a function is needed, and need not be specifically referenced herein, or associated with the other components of the inventive device. For example, a children's toy may have a need to provide electrical energy to perform a task such as lighting a colored LED for entertainment of the child, every time a MSG-style mechanism is pulled back and released through its range of motion. Other sensors and sensor systems may have use of the present invention as well, including trip-wire sensors, wherein a striker or other movable assembly is released by the severing of a holding mechanism and causes the movable element to insert a permanent magnet into a coil, generating an electrical signal. Such implementations, in whole or in part, are included in the substance of this inventive device, unless already covered in prior publications.

What is claimed is:

1. A safety fuze for use in a grenade, comprising:

a fuze body that includes a striker body and a manual safety device;

an electronic unit housed within the striker body, to initiate an explosive train; a safety and arming device housed within the striker body;

a power generation source for selectively energizing the electronic unit and the safety and arming device, upon activation;

wherein the power generation source is housed partly within the fuze body and partly within the manual safety device;

wherein, in a deactivated state, the power generation source includes a striker that is housed within the manual safety device, and a complementary component that is housed within the striker body, along with a safety and arming device that keeps the explosive train out of line until activation;

wherein upon release of the manual safety device, the striker is released from within the manual safety device and rotates around a pivot mechanism in order to strike and compress the complementary component; and where n the compression of the complementary component by the striker causes the power generation source to be activated.

2. The safety fuze according to claim 1, wherein the power generation source includes a piezoelectric striker generator.

3. The safety fuze according to claim 2, wherein the striker of the piezoelectric striker generator includes a weighted block.

4. The safety fuze according to claim 3, wherein the complementary component includes a piezoelectric element.

5. The safety fuze according to claim 4, wherein the weighted block is mounted on the pivot mechanism for allowing a rotational displacement of the weighted block against the piezoelectric element, in order to generate an electrical current.

6. The safety fuze according to claim 5, wherein the pivot mechanism includes an elastic element that effects movement of the pivot mechanism, and that is secured at another end to a hard mount within the manual safety device.

7. The safety fuze according to claim 1, wherein the manual safety device includes an activating lever.

8. The safety fuze according to claim 7, wherein the manual safety device further includes a safety lever.

9. The safety fuze according to claim 8, wherein the release of the manual safely device includes a sequential occurrence of the removal of the safety pin and the release of the safety lever.

10. The safety fuze according to claim 9, wherein the fuze enters an armed, activated state upon sensing any one or more of: an impact of the grenade with a target, and a time delay trigger.

* * * * *